US008122668B2

(12) United States Patent
Fang

(10) Patent No.: US 8,122,668 B2
(45) Date of Patent: Feb. 28, 2012

(54) BRICK ASSEMBLY

(76) Inventor: Tsan-Tang Fang, Tainan (TW)

( * ) Notice: Subject to any disclaimer, the term of this patent is extended or adjusted under 35 U.S.C. 154(b) by 93 days.

(21) Appl. No.: 12/782,093

(22) Filed: May 18, 2010

(65) Prior Publication Data

US 2011/0283647 A1 Nov. 24, 2011

(51) Int. Cl.
*E04B 1/02* (2006.01)

(52) U.S. Cl. ..... 52/568; 52/285.2; 52/565; 52/582.1; 52/592.5; 52/606

(58) Field of Classification Search ..... 52/23, 144, 52/223.7, 284, 285.2, 293.3, 503, 561, 564–566, 52/568, 582.1, 592.5, 596, 606, 745.1
See application file for complete search history.

(56) References Cited

U.S. PATENT DOCUMENTS

| | | | | |
|---|---|---|---|---|
| 4,091,585 | A * | 5/1978 | Rudichuk | 52/274 |
| 5,560,167 | A * | 10/1996 | Miceli | 52/285.4 |
| 6,098,357 | A * | 8/2000 | Franklin et al. | 52/223.7 |
| 6,178,714 | B1 * | 1/2001 | Carney, Jr. | 52/564 |
| 2007/0186502 | A1 * | 8/2007 | Marsh et al. | 52/604 |

* cited by examiner

*Primary Examiner* — Brian Glessner
*Assistant Examiner* — Adam Barlow

(57) ABSTRACT

A brick assembly includes multiple bricks and each brick has at least one rib and at least one slot respectively on two sides thereof so as to be connected side-by-side. Each brick includes multiple passages defined through the top surface and the bottom surface thereof and multiple first recesses are defined in the top surface and multiple second recesses are defined in the bottom surface of the brick. Each of the first and second recesses communicates with two passages. A U-shaped reinforcement bar extends through the two passages and the connection portion connected between two ends of the two legs is engaged with the second recess and a plate is engaged with the first recess. The two legs extend through the plate and are securely connected with two nuts.

4 Claims, 10 Drawing Sheets

BRICK ASSEMBLY

FIELD OF THE INVENTION

The present invention relates to a building material, and more particularly, to a brick assembly which is easily to be connected to each other and environmental friendly.

BACKGROUND OF THE INVENTION

A conventional interior wall generally includes laminated boards or bricks However, the laminated boards do not provide sufficient structural strength so that they are easily to be damaged. Besides, noise can easily penetrate through the laminated boards and the laminated boards are easily burned.

The interior walls made of bricks are strong and improve all of the inherent shortcomings of the interior walls made of laminated boards. Nevertheless, it takes longer time to build a brick wall because the bricks have to be stacked one by one with concrete applied between the bricks. This requires certain skill and a final finishing process is required to be removed all the concrete that protrude from the surface of the brick wall. Furthermore, if a brick wall has to be removed, the only way is to completely hammer it down and all of the bricks are destroyed and cannot be reused. The broken bricks are heavy and occupy huge space so that how to deal with the used bricks becomes a problem in each area.

Hollow bricks are developed and include spaces defined therein so that they are less heavy and can be connected to each other by connection rods to form a wall. Nevertheless, the connection between the hollow bricks is not reliable and the wall made of hollow bricks is not satisfied in its strength.

The present invention intends to provide a brick assembly which includes multiple hollow bricks which are connected to each other firmly and securely. The brick assembly is also environmental friendly.

SUMMARY OF THE INVENTION

The present invention relates to a brick assembly which comprises multiple bricks and each brick has a top surface, a bottom surface, a right side, a left side, a front surface and a rear surface. At least one rib and at least one slot are formed respectively on the left and right sides thereof. Multiple passages are defined through the top surface and the bottom surface and are parallel to each other. Multiple first recesses and multiple second recesses are respectively defined in the top and bottom surface of the brick. Each of the first recesses is located perpendicularly to a longitudinal direction of the brick and communicates with two of the passages in the top surface. Each of the second recesses is located perpendicularly to a longitudinal direction of the brick and communicates with two of the passages in the bottom surface.

Multiple connection units each have a reinforcement bar, a plate and nuts, wherein the reinforcement bar is a U-shaped bar and includes two legs and a connection portion is connected between two ends of the two legs. The legs extend through the passages from the bottom surface of the brick and the connection portion is engaged with the second recess. The plate is engaged with the first recess and the legs extend through the plate and are connected with nuts.

The rib and the slot are dove-tailed shaped.

The brick includes spaces defined therein.

The isolation material is filled in the spaces.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
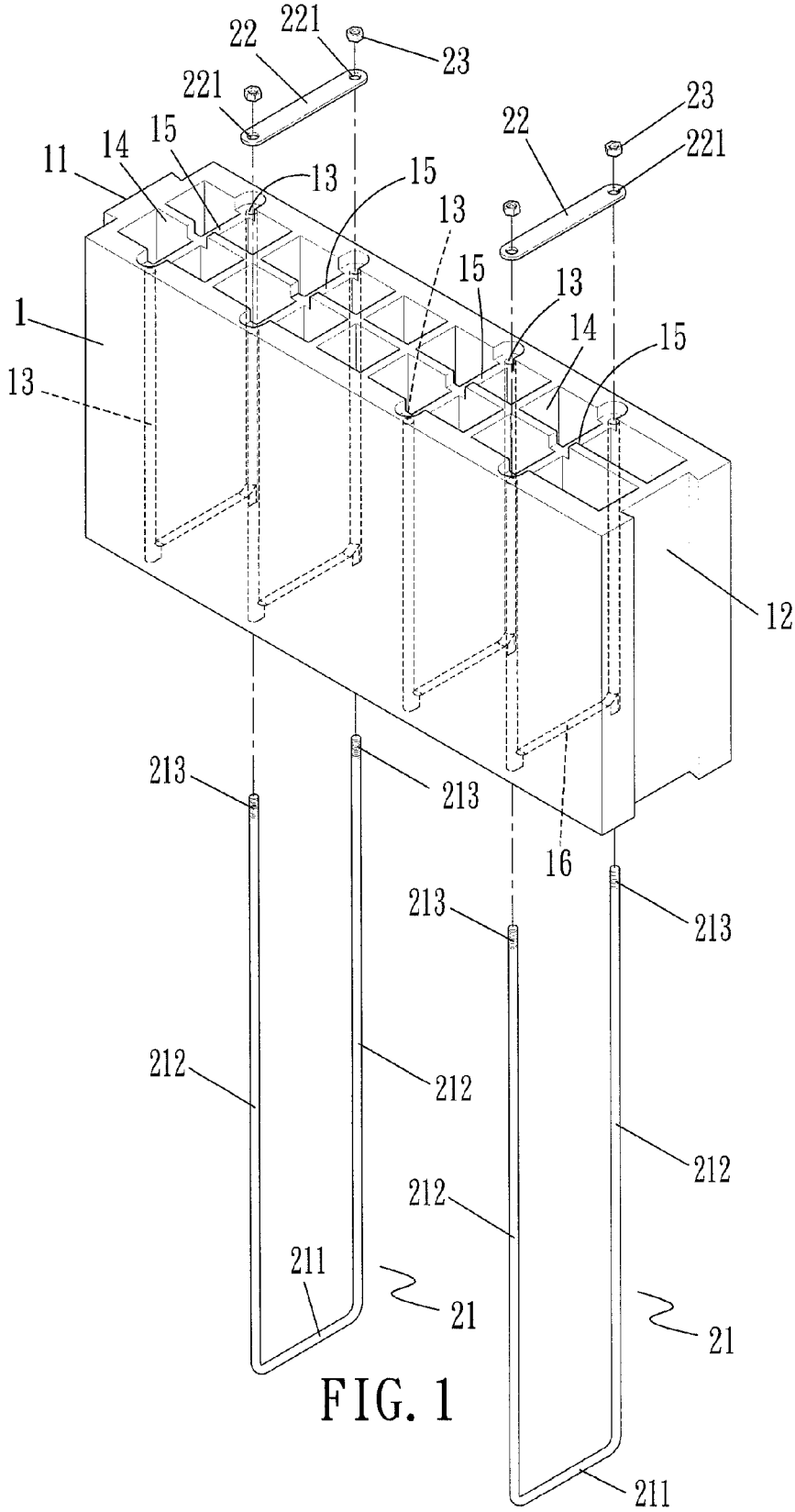
FIG. 1 is an exploded view to show the brick assembly of the present invention.
Figure 2:
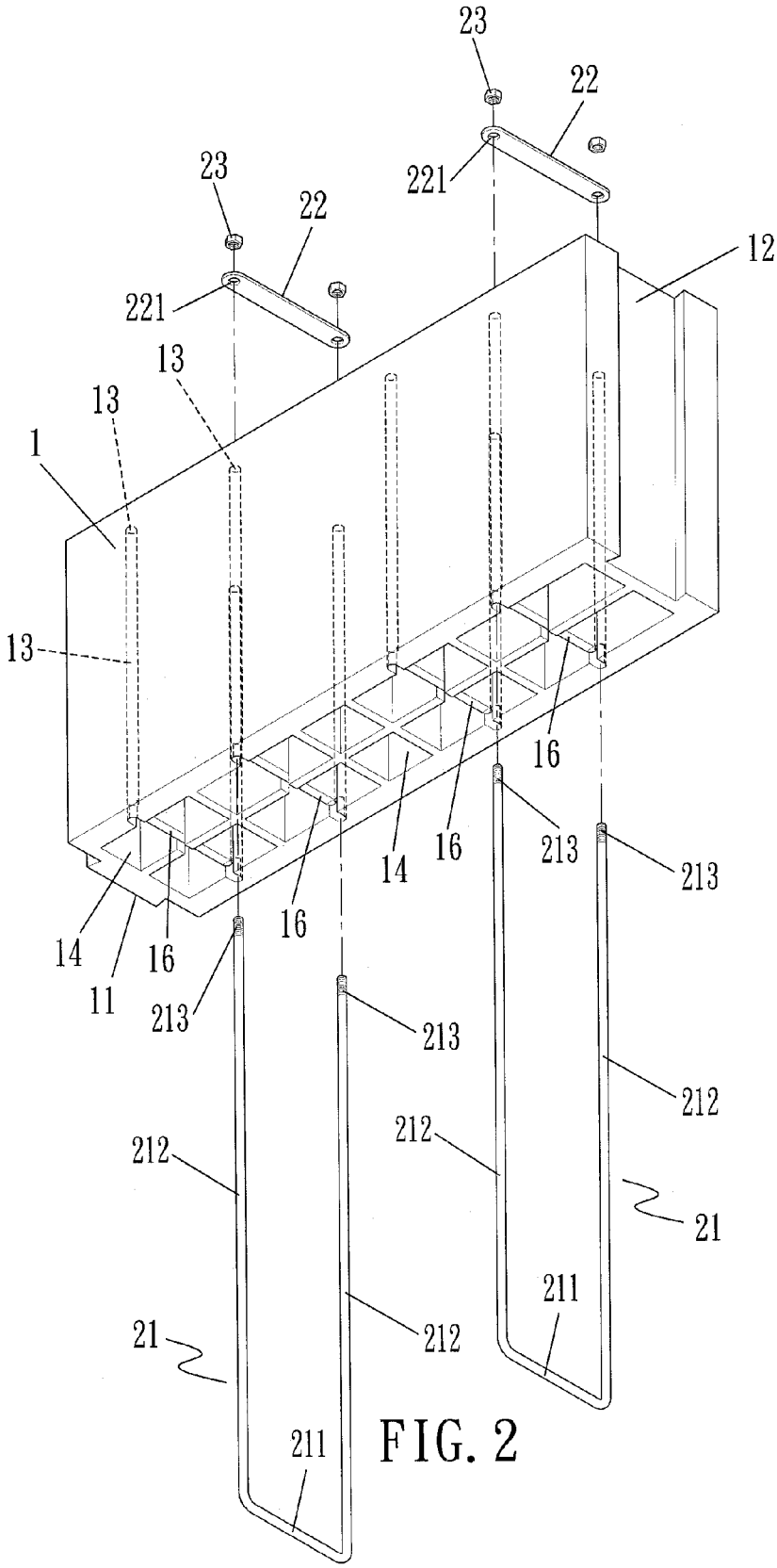
FIG. 2 is another exploded view to show the brick assembly of the present invention.

Referring to FIGS. 1 and 2, the brick assembly of the present invention comprises multiple bricks 1 and multiple connection members for connecting the bricks 1 to each other. The brick 1 includes a top surface, a bottom surface, a right side, a left side, a front surface and a rear surface. A rib 11 protrudes from the left side of the brick 1 and a slot 12 is defined in the right side of the brick 1. The rib 11 and the slot 12 are dove-tailed shaped as shown and other shapes are also able to have the same function. Multiple passages 13 are defined through the top surface and the bottom surface. The passages 13 are parallel to each other. Multiple first recesses 15 are defined in the top surface of the brick 1 and multiple second recesses 16 are defined in the bottom surface of the brick 1. Each of the first recesses 15 is located perpendicularly to a longitudinal direction of the brick 1 and communicates with two of the passages 13 in the top surface. Each of the second recesses 16 is located perpendicularly to a longitudinal direction of the brick 1 and communicates with two of the passages 13 in the bottom surface. The bricks 1 can be rectangular or square or any shape as needed.

Figure 6:
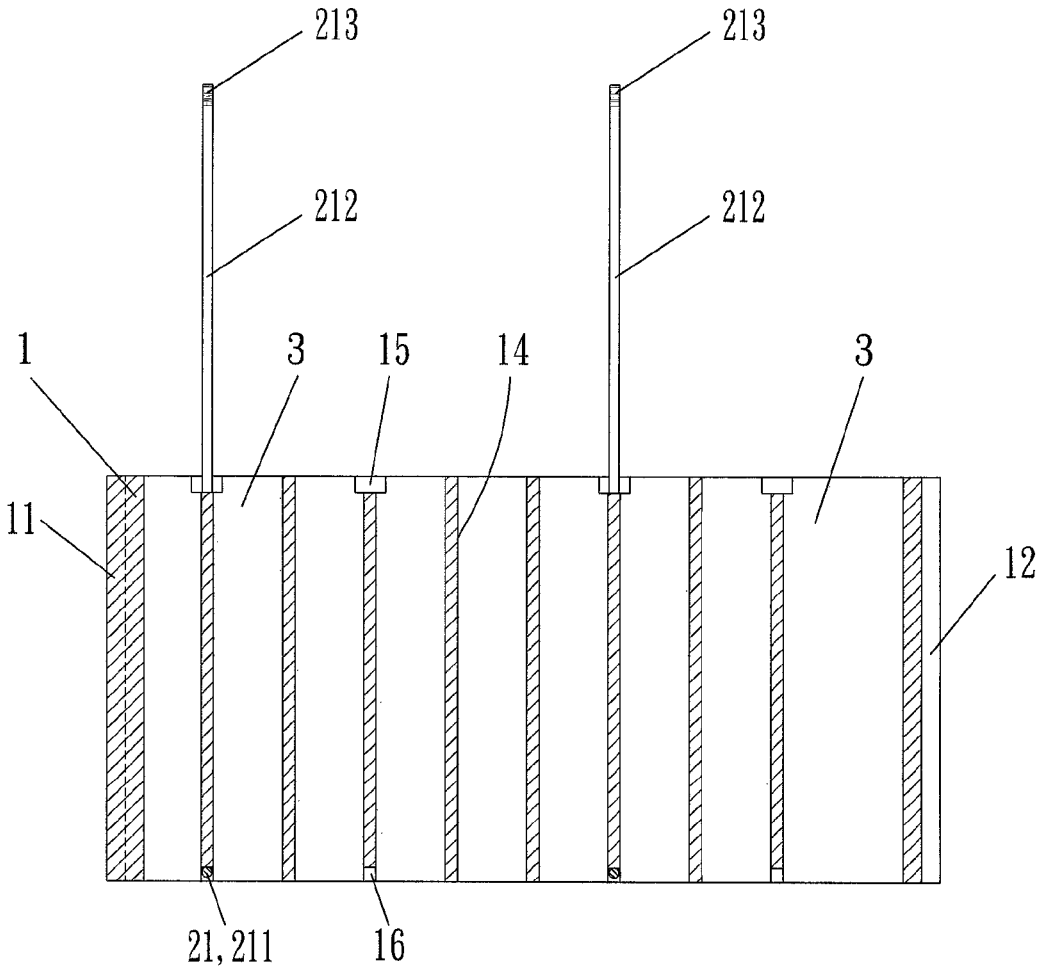
FIG. 6 is a cross sectional view to show isolation material is filled in the spaces of the brick assembly.

The connection units each include a reinforcement bar 21, a plate 22 and nuts 23. The reinforcement bar 21 is a U-shaped bar and includes two legs 212 and a connection portion 211 which is connected between two ends of the two legs 212. The legs 212 extend through the passages 13 from the bottom surface of the brick 1 and each leg 212 includes threads 213 defined in an outer surface thereof. The connection portion 211 is engaged with the second recess 16. The plate 22 is engaged with the first recess 15 and includes two holes 221 in two ends thereof. The two legs 212 extend through the two holes 221 and the portion with the threads 213 protrudes from the top surface of the brick 1 and is connected with a nut 23. Each of the bricks 1 includes spaces 14 defined therein. Isolation material 3 is filled in the spaces 14 as shown in FIG. 6.

Figure 3:
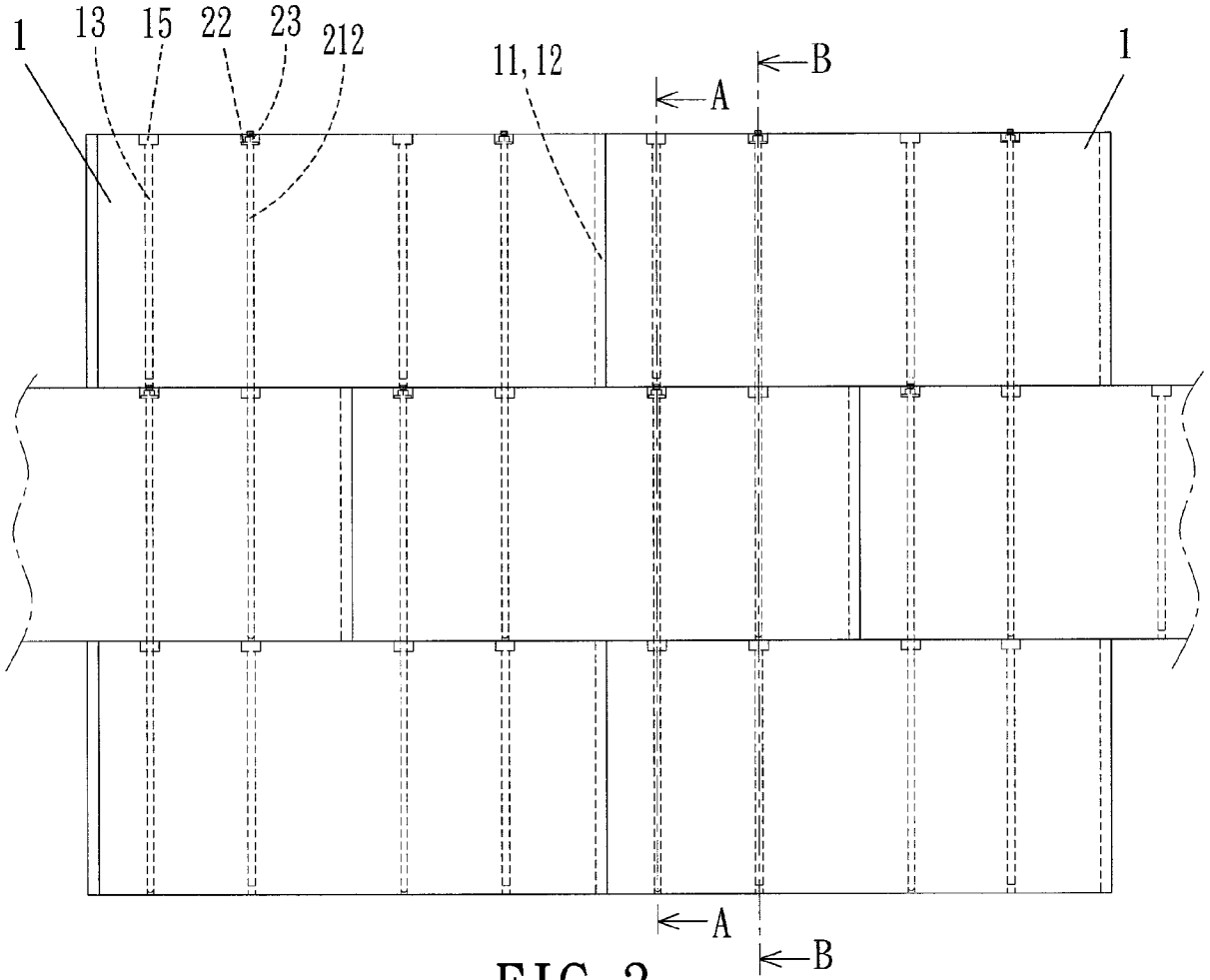
FIG. 3 is a side view to show the brick assembly of the present invention.
Figure 4:
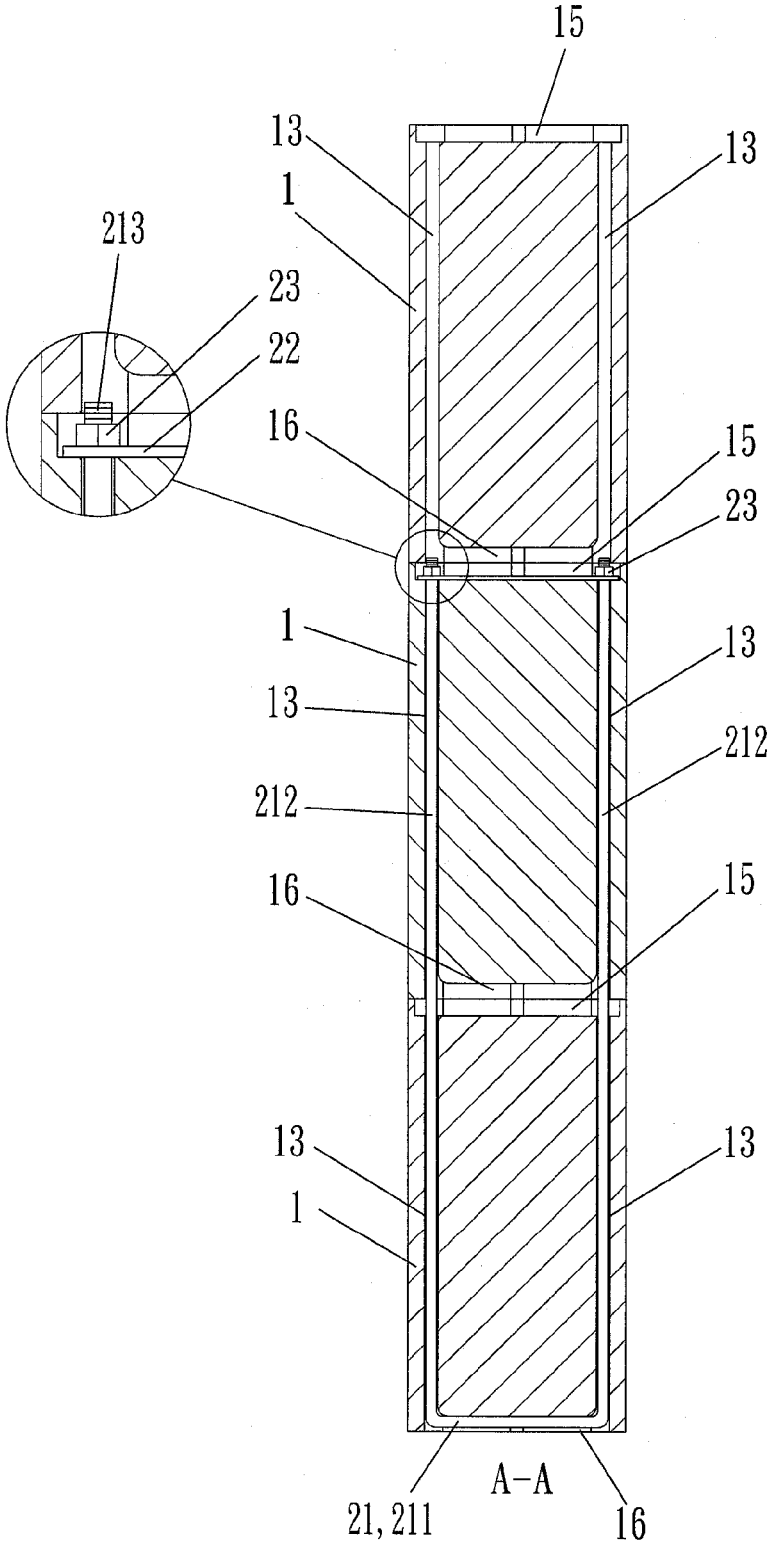
FIG. 4 is a cross sectional view taken along line A-A in FIG. 3.
Figure 5:
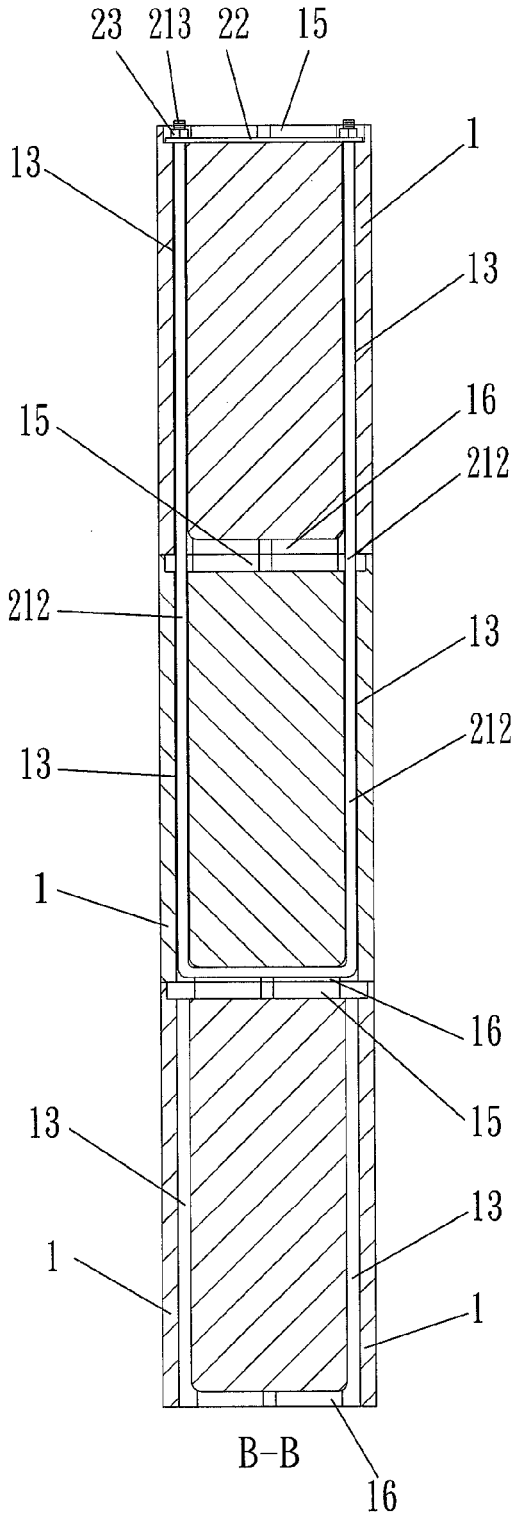
FIG. 5 is a cross sectional view taken along line B-B in FIG. 3.

Referring to FIGS. 3 to 5, when connecting the bricks 1 to form a wall unit, the bricks 1 can be connected to each other side by side by engaging the rib 11 of one brick 1 with the slot 12 of the adjacent brick 1. The reinforcement bars 21 then extend through the passages 13 from the respective bottom surfaces of the bricks 1 connected to each other. Another wall unit is then put on the bricks 1 with the legs 212 extending through the passages 13 thereof. Plates 22 are then mounted to the legs 212 and engaged with the first recesses 15, and nuts 23 are threadedly connected to the threads 213 of the legs 212 to securely connect the bricks 1 in vertical direction. The bricks 1 on the top of the first wall unit are located off alignment with the bricks 1 of the wall unit at the bottom. By this arrangement, each brick 1 contact with two bricks 1 and have better connection between these bricks 1. By repeating the processes to connect the wall units, a larger area of a wall can be built.

Figure 7:
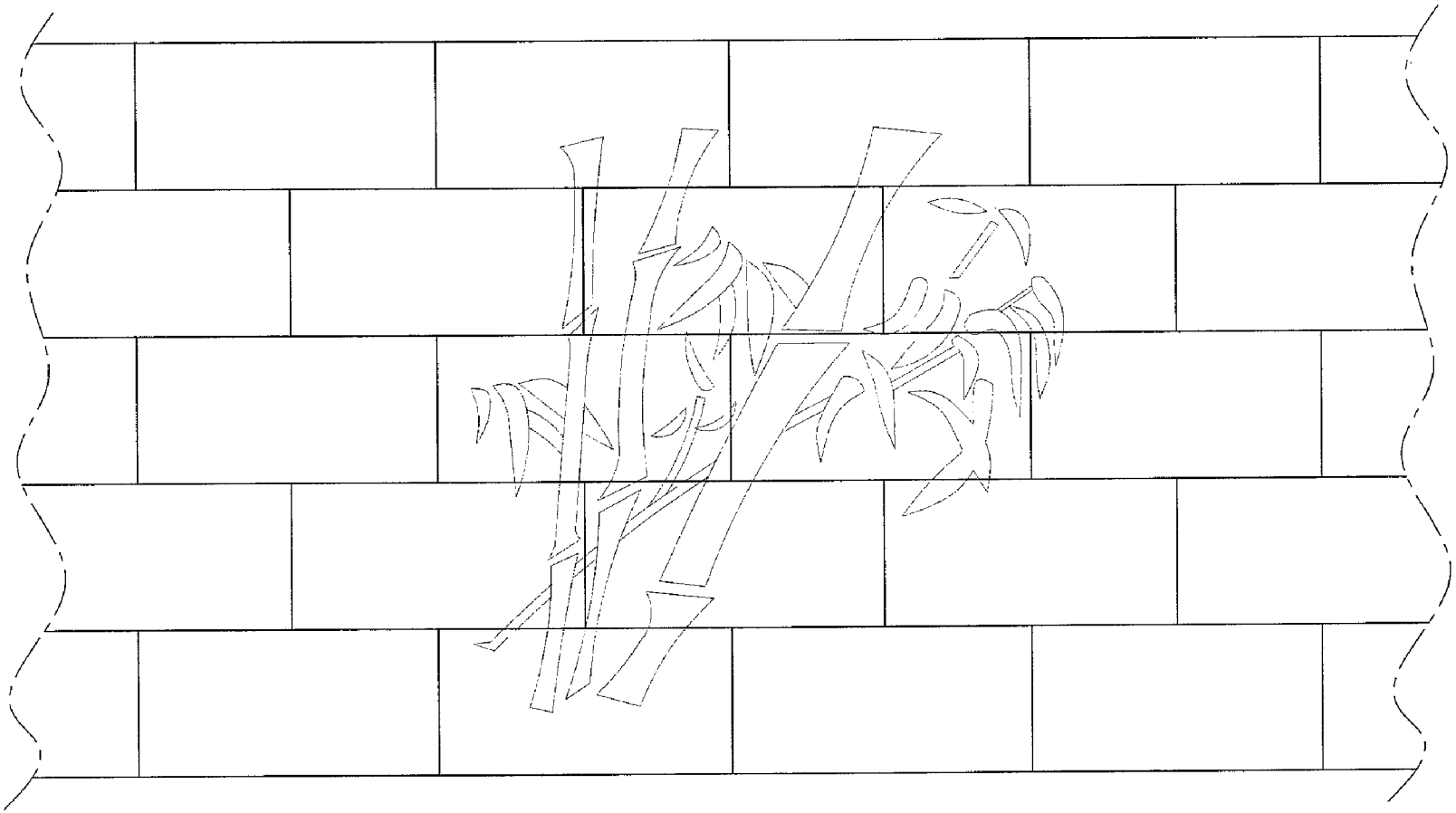
FIG. 7 shows the outer appearance of the brick assembly.

As shown in FIG. 7, each brick 1 can be engraved with a pre-set pattern on the front and rear surfaces, so that when the bricks 1 are connected to each other, a complete pattern is shown on the wall without need of painting or decorating. The patterns can be designed to meet certain topics. The spaces 14 of the bricks 1 can be filled with isolation material 3 to isolate from heat and noise.

Furthermore, when using the bricks 1 to built the outer wall of a building, the building can be a combination house which is used as a temporary shelter in the re-construction programs after disasters to protect people from rain and wind. The brick are easily connected to each other to form a strong structure and the shelters made of the bricks can be survived during extreme weather conditions.

The bricks 1 can also be used to construct a display house or a reception center because the bricks 1 are assembled and dis-assembeld easily and quickly. The conventional display house or reception centers are made for temporary purposes and which are simply made of wooden boards and cannot bear heavy rain and low temperature. After the project is over, the conventional display house or reception centers are torn apart and the boards cannot be reused because of severe damage and the cost for building the conventional display house or reception centers can be so high that reduces the profit of the project. The display houses or reception centers made of the bricks 1 of the present invention can bear heavy rain and wind.

Figure 8:
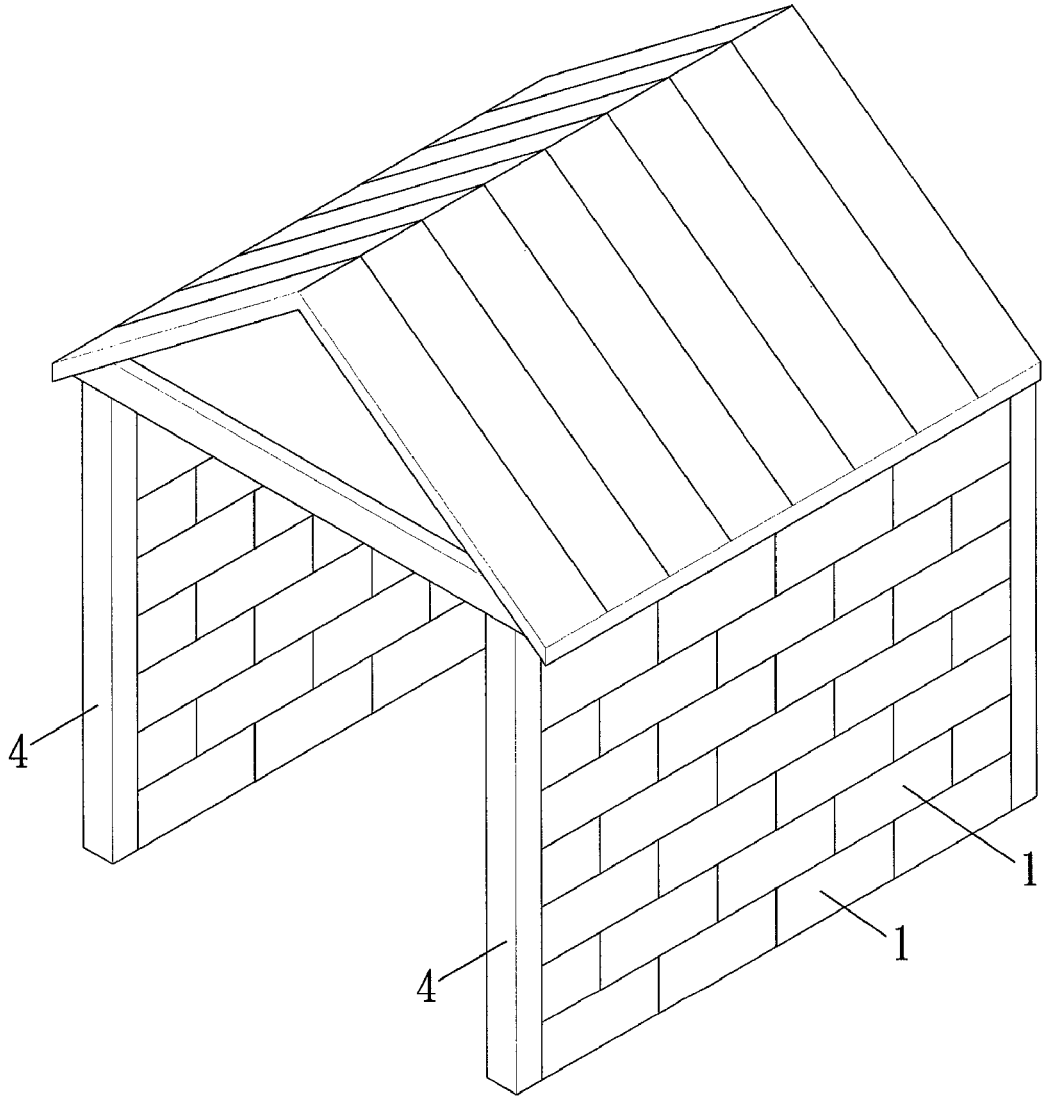
FIG. 8 shows the brick assembly is used to build a shelter.

As shown in FIG. 8, the bricks 1 cooperated with posts 4 can quickly build a shelter as shown and the shelter can be used in emergency situations to provide shelters within short period of time.

Figure 9:
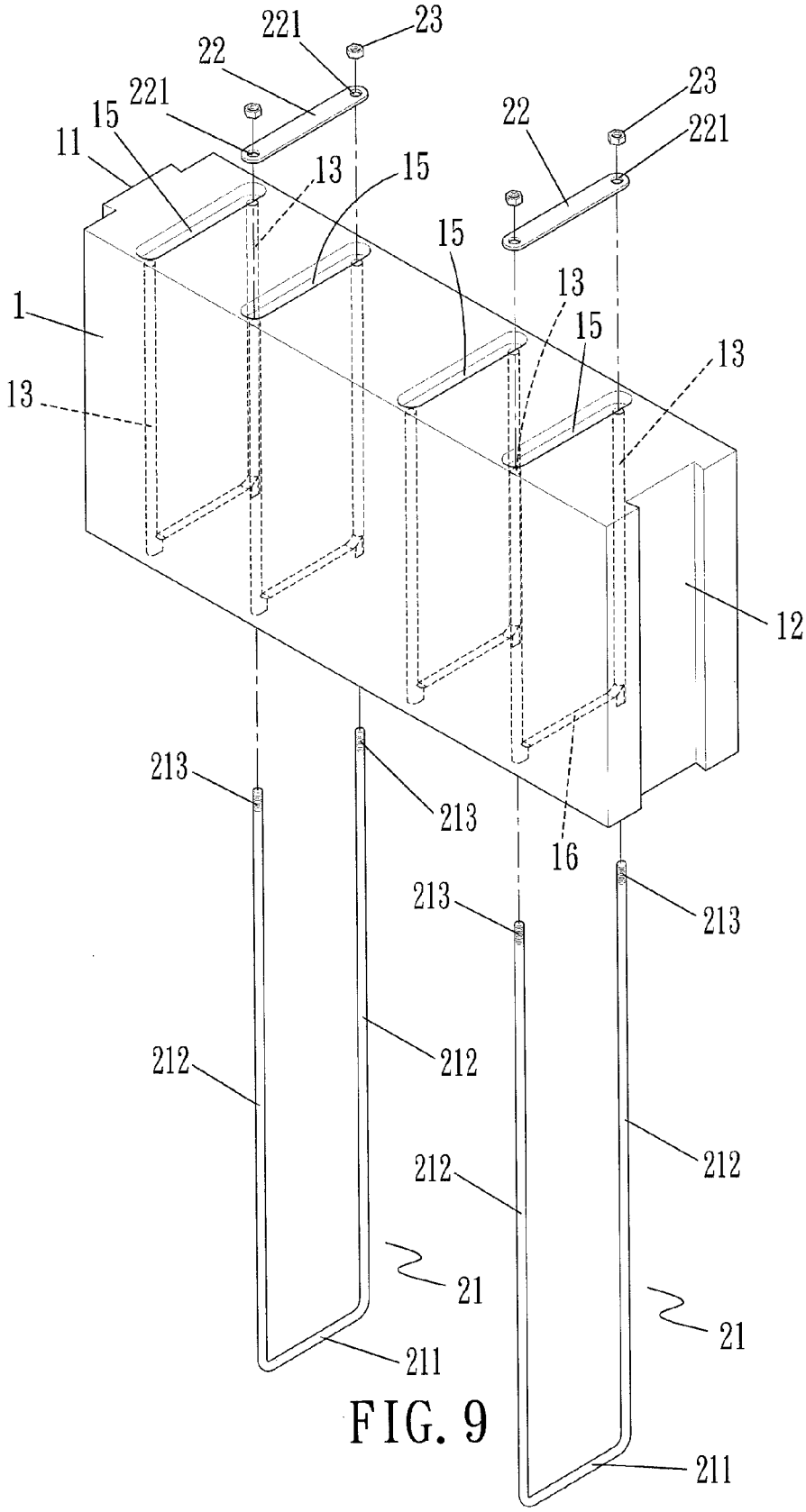
FIG. 9 shows another embodiment of the brick assembly of the present invention.

FIG. 9 shows that the brick 1 can be solid bricks without the spaces 14 and the bricks 1 have the passages 13, the first recesses 15 and the second recesses 16. The solid bricks 1 are used to build a durable and strong wall.

Figure 10:
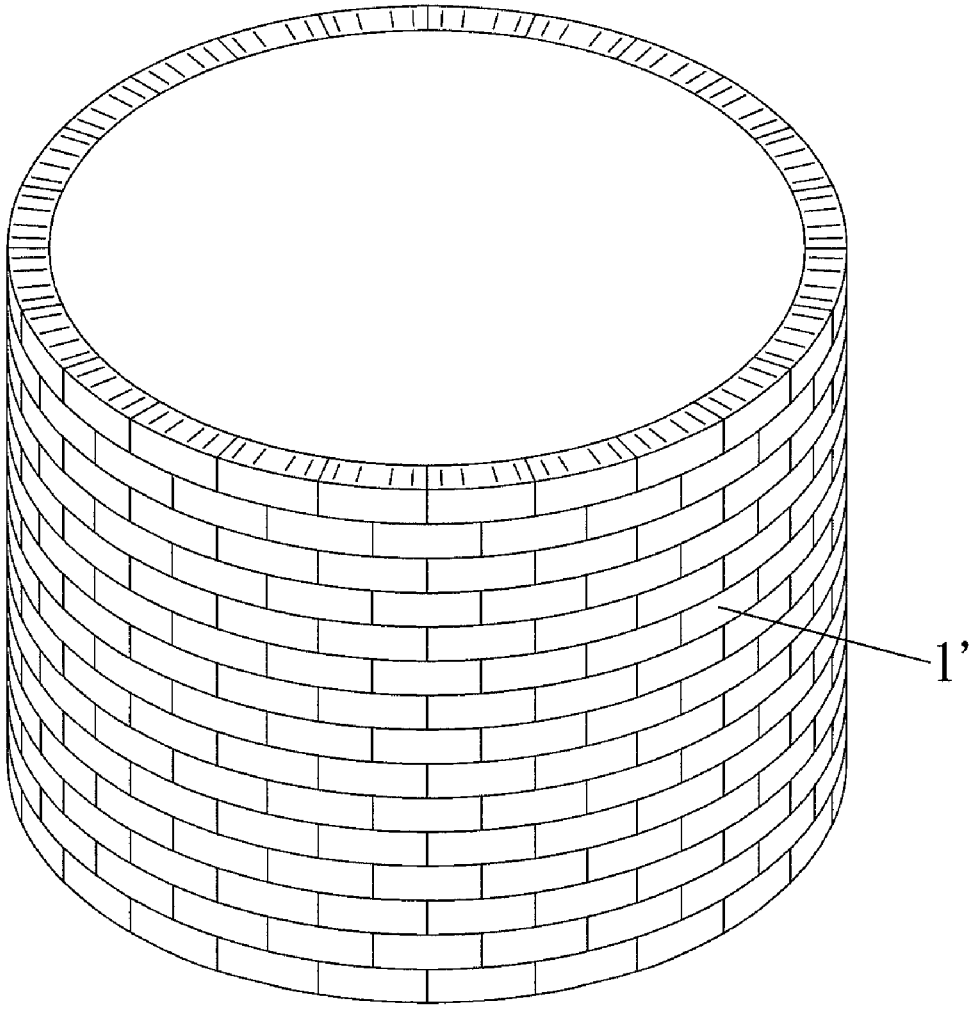
FIG. 10 shows that the brick assembly is used to build a tubular object.

Of course, the bricks 1' can be used to build a cylindrical building as shown in FIG. 10 and the inside of the building is treated with waterproof layer and the building can be used as a tank for storage of water.

There are advantages of the brick assembly of the present invention, which are:

1. The assembly is easily and efficient to shorten the time required. The bricks are connected to each other by connection members without any cement needed. The conventional bricks have to be connected to each other cement and the cement has to be dried to firmly connect the bricks. The present invention significantly shortens the time required and overcomes the shortcoming of the use of conventional bricks.

2. The bricks of the present invention are connected to each other by suing reinforcement bars and nuts so that the connection is reliable and stronger than the conventional way by using cement. There are gaps between the bricks 1 and the gaps can absorb shock waves during earth quake. The conventional bricks do not have the function.

3. The bricks 1 includes chambers 14 defined therein which can be filled with isolation material 3 to effectively reduce the transmission of heat and noise from one space to another.

4. The bricks 1 can be reused and are high valued green construction material. This is because the bricks are connected to each other by reinforcement bars and nuts so that when they are separated from each other, there will be no without damage to the bricks 1. The bricks 1 are ready to be transported to another site and used after they are separated from each other.

5. The bricks 1 are able to be connected to each other within a short period of time and have great features for providing a warm and strong building to keep wind and rain from the building. The bricks 1 can be quickly transported and built to provide shelters after disasters.

While we have shown and described the embodiment in accordance with the present invention, it should be clear to those skilled in the art that further embodiments may be made without departing from the scope of the present invention.

What is claimed is:

1. A brick assembly comprising:

multiple bricks and each brick having a top surface, a bottom surface, a right side, a left side, a front surface and a rear surface, at least one rib protruding from the left side of the brick and at least one slot defined in the right side of the brick, multiple passages defined through the top surface and the bottom surface and being parallel to each other, multiple first recesses defined in the top surface of the brick and multiple second recesses defined in the bottom surface of the brick, each of the first recesses located perpendicularly to a longitudinal direction of the brick and communicating with two of the passages in the top surface, each of the second recesses located perpendicularly to a longitudinal direction of the brick and communicating with two of the passages in the bottom surface, and multiple connection units each having a reinforcement bar, a plate and nuts, the reinforcement bar being a U-shaped bar and including two legs and a connection portion which is connected between two ends of the two legs, the legs extending through the passages from the bottom surface of the brick and the connection portion being engaged with the second recess, the plate engaged with the first recess and having two holes through which the legs extend, each leg including threads which protrude from the top surface of the brick 1 and are connected with nuts.

2. The assembly as claimed in claim 1, wherein the at least one rib and the at least one slot are dove-tailed shaped.

3. The assembly as claimed in claim 1, wherein the brick 1 includes spaces defined therein.

4. The assembly as claimed in claim 3, wherein isolation material is filled in the spaces.

* * * * *